US008210667B2

(12) United States Patent
Saeki et al.

(10) Patent No.: US 8,210,667 B2
(45) Date of Patent: Jul. 3, 2012

(54) LIQUID APPLICATION MECHANISM AND INKJET RECORDING APPARATUS

(75) Inventors: Tsuyoshi Saeki, Kawasaki (JP); Tetsu Hamano, Tokyo (JP); Junichi Yoshikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 400 days.

(21) Appl. No.: 12/636,065

(22) Filed: Dec. 11, 2009

(65) Prior Publication Data

US 2010/0149289 A1 Jun. 17, 2010

(30) Foreign Application Priority Data

Dec. 17, 2008 (JP) ..... 2008-320810
Apr. 30, 2009 (JP) ..... 2009-110996
Oct. 13, 2009 (JP) ..... 2009-236436

(51) Int. Cl.
*B41J 2/175* (2006.01)
*B41J 2/18* (2006.01)

(52) U.S. Cl. ..... 347/85; 347/89

(58) Field of Classification Search ..... 347/85, 347/89

See application file for complete search history.

(56) References Cited

U.S. PATENT DOCUMENTS 7,364,664 B2 4/2008 Shimoyama
7,497,340 B2 * 3/2009 Hershberger et al. ..... 210/435
7,677,690 B2 * 3/2010 Takatsuka ..... 347/29
2004/0232091 A1 11/2004 Shimoyama
2006/0209140 A1 * 9/2006 Nagai ..... 347/85

FOREIGN PATENT DOCUMENTS

JP 2003-034900 2/2003
JP 2003-210908 7/2003
JP 2004-130614 4/2004
JP 2007-044649 2/2007

* cited by examiner

*Primary Examiner* — Matthew Luu
*Assistant Examiner* — Jannelle M Lebron
(74) *Attorney, Agent, or Firm* — Canon USA Inc IP Division

(57) ABSTRACT

A liquid application mechanism includes a liquid application unit that applies liquid to an application medium, and a liquid supply unit that supplies the liquid to the liquid application unit from a storage unit. The liquid supply unit recovers a portion of the liquid to the storage unit, the portion of the liquid being a portion that has been supplied to the liquid application unit and has not been applied to the application medium. At a bottom portion of the storage unit, a plurality of trap space sections separated from each other by ribs are formed. The trap space sections have continuous rectangular shapes, and are open upward in the direction opposite to gravity. The rib height of the trap space sections is equal to or greater than 3 mm, and the rib interval of the trap space sections is in the range from 2 mm to 10 mm.

4 Claims, 11 Drawing Sheets

LIQUID APPLICATION MECHANISM AND INKJET RECORDING APPARATUS

BACKGROUND OF THE INVENTION

1. Field of the Invention

The present invention relates to a liquid application mechanism and an inkjet recording apparatus.

2. Description of the Related Art

In the technical field of inkjet recording, in order to improve the quality of recording using ink including a coloring material such as a pigment, a technique of applying process liquid, which promotes aggregation of the pigment, to a recording medium (recording paper) has been proposed. When ink including a pigment is ejected onto a recording medium that has been treated with the process liquid, the pigment is insolubilized, so that the density of recording can be improved and bleeding can be reduced or prevented. As a result, the quality of recording is improved.

Japanese Patent Laid-Open No. 2007-44649, for example, discloses a liquid application mechanism for applying process liquid to a recording medium. This publication discloses a mechanism including an application member including an application roller for applying application liquid to a recording medium, a liquid holding member for holding the application liquid between the liquid holding member and the application member, a storage unit for storing the application liquid, a pump for circulating the application liquid, and a channel through which the application liquid flows between the storage unit and the application member. A supply port is disposed at one end of the liquid holding member so that the application liquid can be supplied from the storage tank to the liquid holding member. A recovery port is disposed at the other end of the liquid holding member so that the application liquid can be recovered to the storage unit.

In the liquid application mechanism, foreign substances on a recording medium or foreign substances generated by friction between the application member (application roller) and a recording medium (for example, paper powder) may be transported together with the application liquid that is recovered via the application member and the liquid holding member, and the foreign substances may enter the application liquid stored in the storage unit. If the application liquid including the foreign substances circulates through a channel or other members, the foreign substances may block the channel and may impair circulation, a recording medium to which the application liquid is applied may be soiled with the foreign substances, or the foreign substances on the recording medium may adhere to a conveying unit and the precision of conveyance may decrease.

While the application liquid does not circulate in the liquid application mechanism, the foreign substances in the application liquid in the storage unit settle due to gravitation and are deposited on the bottom surface of the storage unit. At this time, the application liquid and the foreign substances are separated from each other. However, when circulation of the application liquid is restarted, the foreign substances that have been deposited on the bottom surface are raised and mixed into the application liquid. In order to suppress this phenomenon, the liquid application apparatus disclosed in Japanese Patent Laid-Open No. 2007-44649 includes a trap space section in a storage unit for storing liquid, the trap space section having an opening below an outlet for supplying the liquid to a liquid holding member. While liquid is circulating or is not circulating, the foreign substances are guided into the trap space section through the opening, and the foreign substances are removed from the liquid.

Japanese Patent Laid-Open No. 2004-130614 discloses a technology for preventing foreign substances from being circulated in a liquid application mechanism so that the function of the liquid application mechanism may not be impaired due to entry of the foreign substances into the application liquid. With this technology, liquid including foreign substances that have entered a circulation channel from the outside is filtered using a filter so as to remove the foreign substances from the liquid.

However, with the apparatus disclosed in Japanese Patent Laid-Open No. 2007-44649, which includes the trap space section disposed at the bottom of the storage unit, although the foreign substances that enter through the opening of the trap space section can be trapped, the foreign substances that have been deposited on portions excluding the opening of the trap space section cannot be trapped in the trap space section. Therefore, the foreign substances that have not been trapped in the trap space section may reenter the liquid when the liquid circulates.

With the technology disclosed in Japanese Patent Laid-Open No. 2004-130614, which removes foreign substances using a filter, the filter may become clogged over time, whereby the performance of removing the foreign substances may be impaired and the flow resistance when liquid circulates may increase. In particular, this problem is significant when a fine-pitched filter is used so as to improve the performance of removing the foreign substances. Therefore, the filter has to be frequently replaced or cleaned, which requires manpower.

SUMMARY OF THE INVENTION

The present invention provides an liquid application mechanism including a storage unit having a structure with which foreign substances can be efficiently removed from application liquid being used in circulation, and an inkjet recording apparatus including the liquid application mechanism.

A liquid application mechanism according to the present invention includes a liquid application unit that applies liquid to an application medium, the liquid being supplied; and a liquid supply unit that supplies liquid stored in a storage unit to the liquid application unit by making the liquid flow out from an outlet of the storage unit, and recovers a portion of the liquid to the storage unit by making the portion of the liquid flow into the storage unit through an inlet of the storage unit, the portion of the liquid being a portion of the liquid that has been supplied to the liquid application unit and has not been applied to the application medium by the liquid application unit, wherein, a plurality of trap space sections are formed at a bottom portion of the storage unit, the trap space sections being separated from each other with wall members, the trap space sections having continuous rectangular shapes, sides of each of the trap space sections being surrounded by the wall members, the trap space sections being open upward in a direction opposite to gravity, the trap space sections having a length equal to or greater than 3 mm in a direction of gravity and a length in the range from 2 mm to 10 mm in a horizontal direction.

The present invention provides the liquid application mechanism having a structure with which foreign substances can be sufficiently removed from the application liquid, between the time when the application liquid including the foreign substances is recovered to the storage unit and the time when the application liquid is resupplied from the storage unit, so that the application liquid can be applied to a recording medium without being affected by the foreign substances. The present invention also provides an inkjet recording apparatus including the liquid application mechanism.

Further features of the present invention will become apparent from the following description of exemplary embodiments with reference to the attached drawings.

DESCRIPTION OF THE EMBODIMENTS

Hereinafter, embodiments of the present invention are described with reference to the drawings.

Embodiment of Liquid Application Mechanism

Overall Structure

Figure 1:
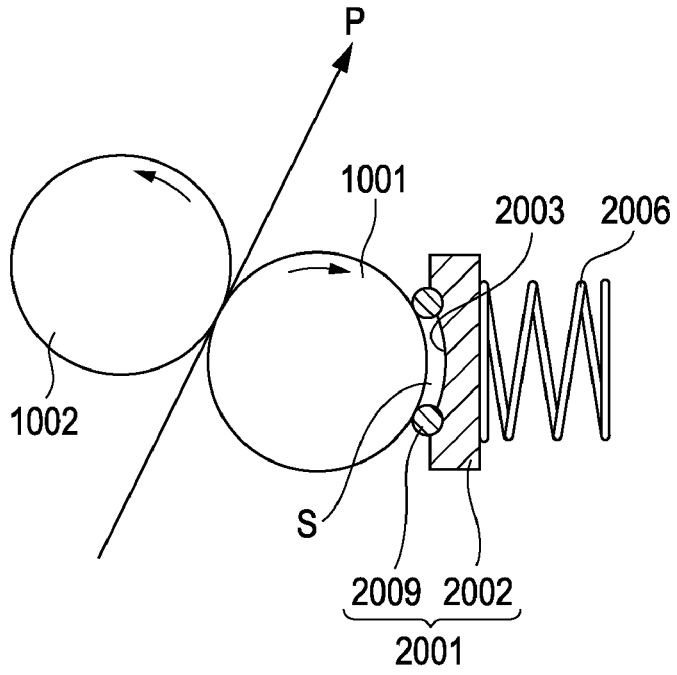
FIG. 1 is a schematic view illustrating the vicinity of an application roller of a liquid application mechanism.

FIG. 1 is a schematic view of a liquid application unit. The liquid application unit includes an application roller 1001 having a cylindrical shape, a counter roller 1002 facing the application roller 1001, and a roller drive mechanism (not shown) that drives the application roller 1001. The roller drive mechanism includes a roller drive motor (not shown) and a transmission mechanism. The transmission mechanism includes a gear train (not shown) that transmits the power of the roller drive motor to the application roller 1001.

The liquid application unit further includes a liquid holding member 2001 and a liquid channel 3000. The liquid holding member 2001 holds application liquid between the liquid holding member 2001 and an outer peripheral surface of the application roller 1001. The liquid channel 3000 (not shown in FIG. 1, see FIG. 3) supplies the application liquid to the liquid holding member 2001. The axis of the application roller 1001 and the axis of the counter roller 1002 are parallel to each other. Ends of the axes are rotatably supported by a frame (not shown). The liquid holding member 2001 extends over substantially the entire length of the application roller 1001. The liquid holding member 2001 is movably attached to the frame via a mechanism that allows the liquid holding member 2001 to be in contact with or separated from the outer peripheral surface of the application roller 1001.

Liquid Application Unit

The counter roller 1002 is urged against the outer peripheral surface of the application roller 1001. Thus, when the application roller 1001 rotates clockwise in FIG. 1 (the direction indicated by an arrow), an application medium P is nipped between the rollers and conveyed in the direction indicated by the arrow.

In the present embodiment, the application roller 1001 is made of a silicone-based material having a hardness of 20, a surface roughness Ra of about 1.0 to 2.0 μm, and a diameter of 23.169 mm. The counter roller 1002 is made of an iron-based material, and has a diameter of 12 mm.

When the liquid holding member 2001 is urged by a spring member (pressing unit) 2006 and contacts the outer peripheral surface of the application roller 1001, a liquid holding space S having an elongated shape is formed. The liquid holding space S extends over the entire area of the liquid application region of the application roller 1001. Application liquid is supplied to the liquid holding space S through a liquid channel (not shown in FIG. 1, see FIG. 3) and through the liquid holding member 2001.

Figure 2:
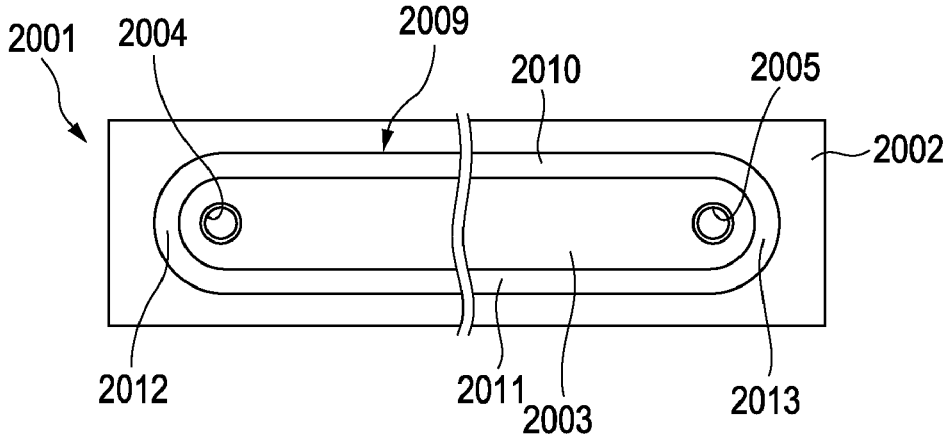
FIG. 2 is a front view of a liquid holding member of the liquid application mechanism.

As illustrated in FIG. 2, the liquid holding member 2001 includes a space forming base 2002 and a contact member 2009. The contact member 2009, having an annular shape, is disposed on a surface of the space forming base 2002. A concave portion 2003 is formed in the middle part of the space forming base 2002 so as to extend in the longitudinal direction of the space forming base 2002. The contact member 2009 is fixed to the space forming base 2002 in such a manner that the contact member 2009 entirely surrounds the concave portion 2003. Portions of the contact member 2009 at ends in the longitudinal direction of the concave portion 2003 are recessed in the depth direction of the concave portion 2003. Thus, the contact member 2009 of the liquid holding member 2001 can contact the outer peripheral surface of the application roller 1001 with a uniform pressure.

As described above, the liquid holding member 2001 of the present embodiment includes the contact member 2009, which is seamlessly and integrally formed, and which contacts the outer peripheral surface of the application roller 1001 continuously and without gaps therebetween urged by the spring member 2006. As a result, the liquid holding space S is a closed space surrounded by the contact member 2009, the concave portion 2003 of the space forming base 2002, and the outer peripheral surface of the application roller 1001. The application liquid is held in the liquid holding space S. Therefore, when the application roller 1001 is not rotating, a liquid-tight state between the contact member 2009 and the outer peripheral surface of the application roller 1001 is maintained, so that the application liquid is prevented from leaking from the liquid holding space S to the outside. Moreover, for the same reason, evaporation of the application liquid from the liquid holding space S can be suppressed.

When the application roller 1001 is rotating, the application liquid passes through a space between the outer peripheral surface of the application roller 1001 and the contact member 2009, and adheres to the outer peripheral surface of the application roller 1001 as a thin layer.

When the application roller 1001 is not rotating, the outer peripheral surface of the application roller 1001 and the contact member 2009 are in a liquid-tight state in the sense that, as described above, the application liquid does not pass from the inside to the outside of the liquid holding space S. In this case, the contact member 2009 may directly contact the outer peripheral surface of the application roller 1001, or may contact the outer peripheral surface of the application roller 1001 with a layer of the application liquid, which is formed by a capillary force, therebetween.

In the region of the space forming base 2002 surrounded by the contact member 2009, a liquid supply port 2004 and a liquid recovery port 2005 extend through the space forming base 2002. The liquid supply port 2004 and the liquid recovery port 2005 communicate with cylindrical connection portions (not shown) that protrude from the back surface of the space forming base 2002. The connection portions are connected to tubes 3102 and 3103 (see FIG. 3), which are described below. In the present embodiment, the liquid supply port 2004 is formed in the vicinity of one end of the region surrounded by the contact member 2009 (left end in FIG. 2), and the liquid recovery port 2005 is formed in the vicinity of the other end of the region (right end in FIG. 2). Through the liquid supply port 2004, the application liquid is supplied from the liquid channel 3000 to the liquid holding space S. Through the liquid recovery port 2005, a portion of the application liquid that has been supplied to the liquid holding space S and has not been applied to an application medium is recovered to the liquid channel 3000. When being supplied or recovered, the application liquid moves from the left end to the right end in the liquid holding space S.

Liquid Channel

Figure 3:
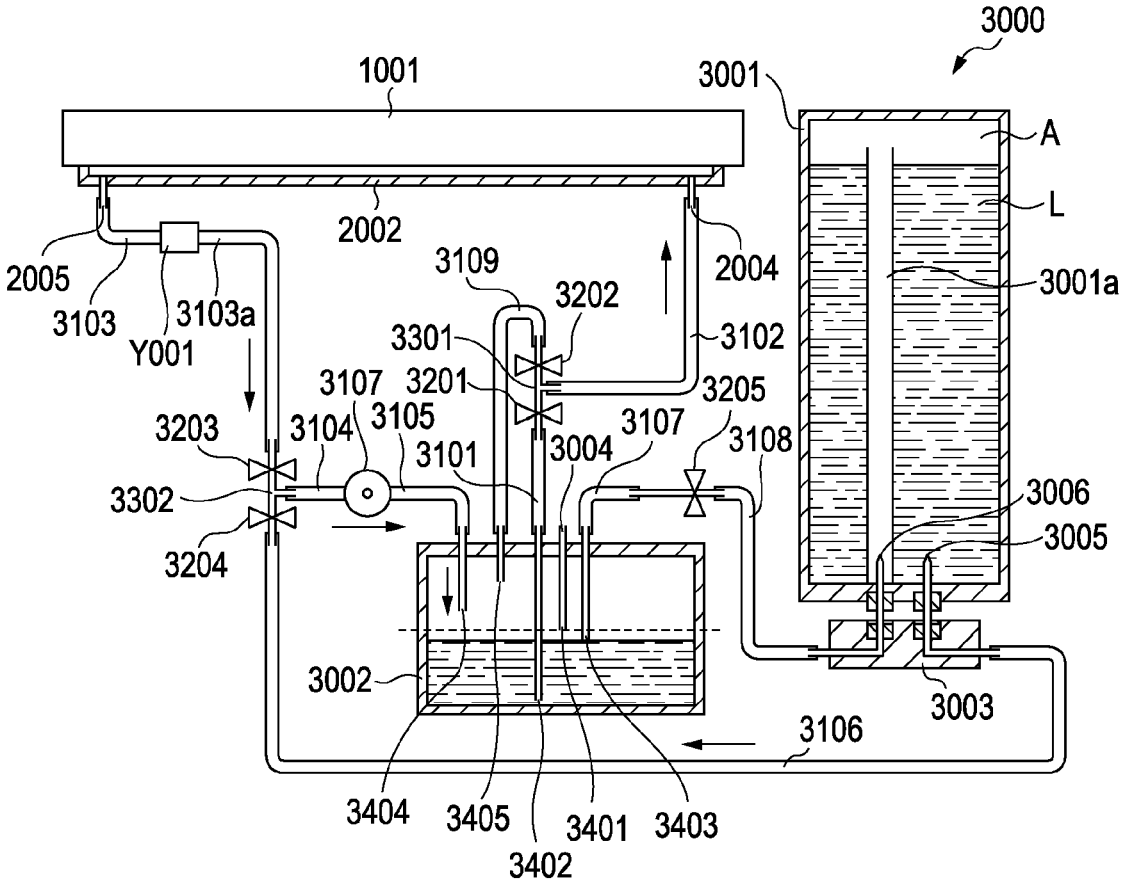
FIG. 3 is a schematic view of a liquid channel of the liquid application mechanism.

FIG. 3 is a schematic view of the liquid channel 3000 connected to the liquid holding member 2001 illustrated in FIG. 2 and other figures.

The liquid channel 3000 includes a first channel constituted by a tube 3101 and the tube 3102. The first channel connects the liquid supply port 2004 in the space forming base 2002 of the liquid holding member 2001 to a storage tank 3002 that stores the application liquid. The liquid channel 3000 further includes a second channel constituted by the tube 3103, a liquid detection sensor Y001, and tubes 3103*a*, 3104, and 3105. The second channel connects the liquid recovery port 2005 in the space forming base 2002 to the storage tank 3002. An air communication port 3004 is disposed in the storage tank 3002.

The liquid detection sensor Y001, which is an electrical detection unit, is disposed in the second channel so as to detect whether the application liquid is present in the space forming base 2002.

The first channel includes a first T-shaped channel 3301 that has openings facing in three directions. The openings of the first T-shaped channel 3301 are each connected to the tube 3101, the tube 3102, and a tube 3109. A first shut-off valve 3201 is disposed on the tube 3101 side of the first T-shaped channel 3301. A second shut-off valve 3202 is disposed on the tube 3109 side of the first T-shaped channel 3301. Using the first and second shut-off valves 3201 and 3202, the channels to the tubes 3101 and 3109 can be opened or closed. An end of the first T-shaped channel 3301 opposite the end connected to the tube 3101 is connected to the storage tank 3002. An end of the tube 3109 opposite the end connected to the first T-shaped channel 3301 is connected to the inner space of the storage tank 3002. The end of the tube 3109 communicates with air outside the storage tank 3002 through the inner space of the storage tank 3002 and through the air communication port 3004.

Using the first shut-off valve 3201, the second shut-off valve 3202, and the first T-shaped channel 3301, the tube 3102 can be selectively connected to air outside the storage tank 3002 or to the application liquid stored in the storage tank 3002.

The second channel includes the tube 3103, the liquid detection sensor Y001, and the tubes 3103*a*, 3104, and 3105. The second channel further includes a pump 3007 that makes the application liquid and the air in the liquid channel 3000 flow toward the storage tank 3002. The tube 3104 is connected to one end of the pump 3007 from which the application liquid is drawn in. The tube 3105 is connected to the other end of the pump 3007 from which the application liquid is discharged. The tube 3105 connects the storage tank 3002 and the pump 3007.

By connecting the storage tank 3002 and the space forming base 2002 through the first and second channels and by driving the pump 3007, the application liquid in the storage tank 3002 can be circulated through the first and second channels and supplied to the space forming base 2002.

The liquid channel 3000 includes a replaceable tank 3001 that has a capacity larger than that of the storage tank 3002. The replaceable tank 3001 stores the application liquid to be supplied to the storage tank 3002. The liquid channel 3000 further includes a third channel and a fourth channel. The third channel connects the replaceable tank 3001 and the second channel. The fourth channel connects the storage tank 3002 and the replaceable tank 3001.

One opening of a tube 3106 of the third channel is connected to the replaceable tank 3001 through a first connection port 3005 and a base 3003. The first connection port 3005 has a needle-shaped opening. The base 3003 has a connection channel formed therein. The other opening of the tube 3106 is connected to a second T-shaped channel 3302. In the present embodiment, the tube 3106 serves as a channel through which the application liquid is supplied from the replaceable tank 3001 to the storage tank 3002.

The second T-shaped channel 3302 has three openings connected to the tubes 3103*a*, 3104, and 3106. A third shut-off valve 3203 is disposed on the tube 3103*a* side of the second T-shaped channel 3302. A fourth shut-off valve 3204 is disposed on the tube 3106 side of the second T-shaped channel 3302. Using the third and fourth shut-off valves 3203 and 3204, the channels to the tubes 3103*a* and 3106 can be opened or closed. Thus, the tube 3104 can be selectively connected to the replaceable tank 3001 or to the space forming base 2002.

The fourth channel includes tubes 3107 and 3108. The tube 3108 of the fourth channel is connected to the replaceable tank 3001 through a second connection port 3006 and the base 3003. The second connection port 3006 is needle-shaped. The base 3003 has the connection channel formed therein. The replaceable tank 3001 communicates with the storage tank 3002 through the tubes 3107 and 3108. A fifth shut-off valve 3205 is disposed between the tubes 3107 and 3108. A channel between the tubes 3107 and 3108 can be opened or closed using the fifth shut-off valve 3205.

An air communication pipe 3001*a* is disposed in the replaceable tank 3001. The air communication pipe 3001*a* has a lower end connected to the second connection port 3006 and an upper end protruding into air space A in the replaceable tank 3001. With this structure, the internal pressure of the replaceable tank 3001 can be adjusted to the atmospheric pressure by opening the fifth shut-off valve 3205 without making the application liquid L in the replaceable tank 3001 flow into the channels.

By providing the fourth channel, an air communication port is not necessary for the replaceable tank 3001. Moreover, the application liquid can be supplied from the replaceable tank 3001 to the storage tank 3002 in a circulatory manner.

The shut-off valves can be switched with control signals supplied from a control unit 4000 (described below), so that the storage tank 3002 can be filled with the application liquid and the application liquid can be supplied and recovered. Specific operations are described below.

In the present embodiment, when the storage tank 3002 is provided for the purpose of controlling the difference in the hydraulic head, members required for applying the liquid can be included in the same liquid application mechanism.

Next, a mechanism for removing foreign substances from the application liquid, which is a characteristic portion of the liquid application mechanism according to the present embodiment, is described.

Foreign substances may enter the liquid application mechanism via an application member. The foreign substances are recovered to the storage tank 3002 together with the application liquid during recovery operation of the application liquid. The foreign substances in the storage tank 3002 settle due to gravitation and are deposited on the bottom of the storage tank 3002. When a circulation operation is restarted, flow of the application liquid is generated in the storage tank 3002. At this time, the deposited foreign substances can be readily raised in the application liquid. In the liquid application mechanism according to the present embodiment, trap space sections are formed on the bottom surface of the storage tank 3002 so as to suppress rising of foreign substances during a circulation operation.

Figure 4:
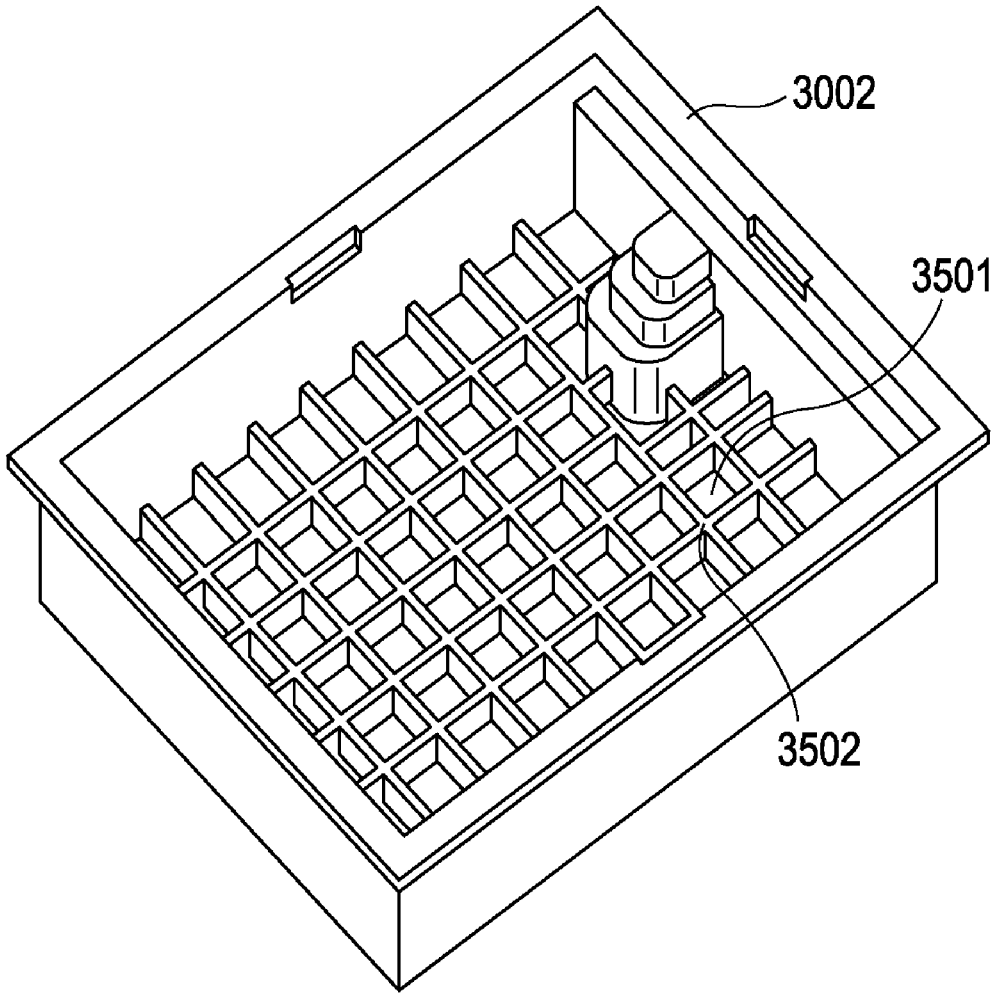
FIG. 4 is a perspective view of a storage tank of the liquid application mechanism.

FIG. 4 is a schematic view illustrating the inside of a storage tank of a liquid application mechanism according to the present embodiment.

Ribs 3502 are formed on the bottom surface of the storage tank 3002. The ribs 3502 intersect with each other in a grid pattern along the bottom surface of the storage tank 3002. Thus, the ribs 3502 form a plurality of trap space sections 3501 that are continuously arranged two-dimensionally along the upper surface of the ribs 3502. The ribs 3502 serve as wall members that surround the sides of each of the trap space sections 3501, and separate the trap space sections 3501 into continuous rectangular shapes. The trap space sections 3501 are open upward in the direction opposite to gravity.

When the application liquid is not being circulated, foreign substances in the application liquid in the storage tank 3002 settle due to gravitation, and are deposited in the trap space sections 3501. When the application liquid flows due to circulation, the foreign substances can be easily raised. However, the ribs 3502 serve to limit the flow rate of the application liquid in the trap space sections 3501, so that rising of the foreign substances in the trap space sections 3501 is suppressed.

Figure 5:
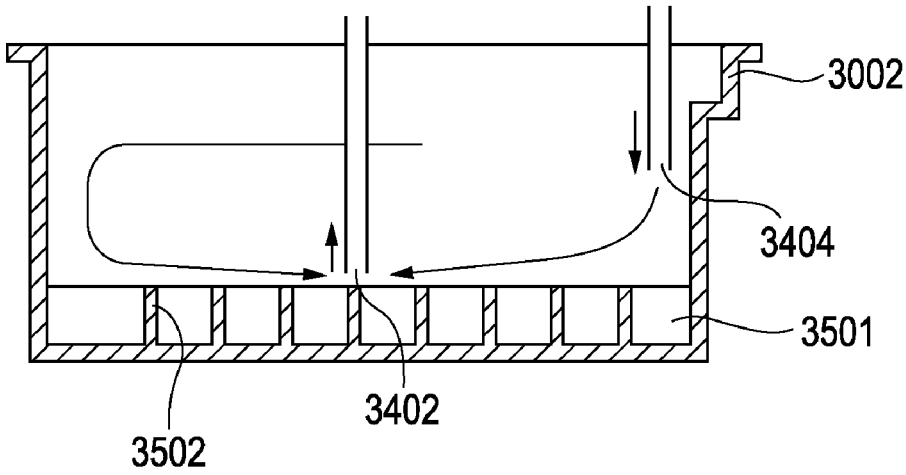
FIG. 5 is a sectional view of the storage tank.

FIG. 5 is a sectional view of the storage tank 3002 of the liquid application mechanism according to the present embodiment. As illustrated in FIG. 5, in the present embodiment, an inlet 3404 and an outlet 3402 are disposed above the upper surface of the ribs 3502 in the direction opposite to gravity. Thus, during circulation, main flow from the inlet 3404 to the outlet 3402 (flow along the arrows in FIG. 5) is generated above the ribs 3502. Therefore, flow of the application liquid into the trap space sections 3501 is suppressed, and rising of the foreign substances can be prevented. While the application liquid is being circulated, the above-described state is maintained.

Structures of the storage tank 3002 and the ribs 3502 of the liquid application mechanism according to the present embodiment are described in detail. The storage tank 3002 in the present embodiment has a width of 59.3 mm and a depth of 45.8 mm.

Figure 6:
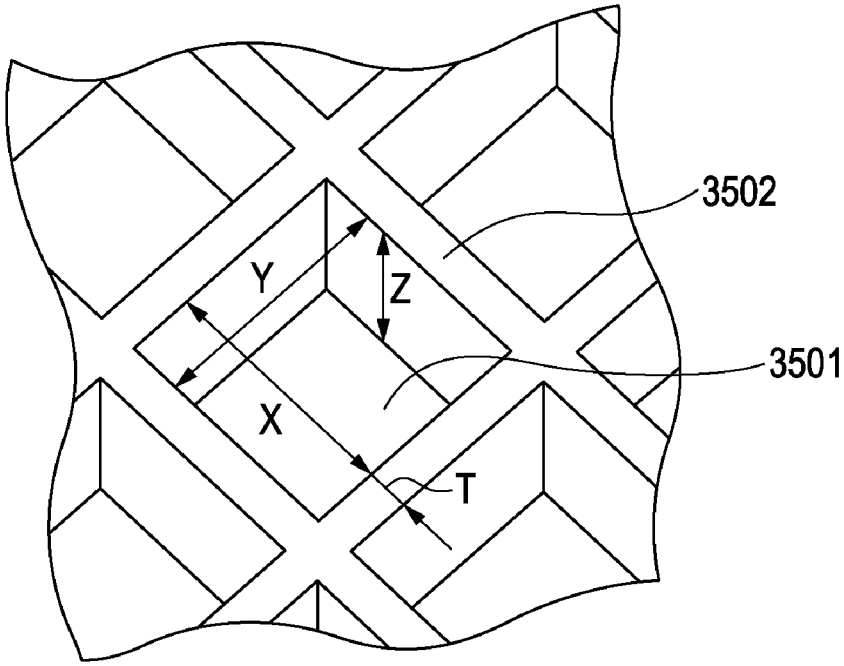
FIG. 6 is an enlarged view of trap space sections of the storage tank.

FIG. 6 is an enlarged view of the trap space sections 3501. The shape of ribs of the storage tank 3002 is determined by a rib thickness T, a rib height Z, and rib intervals X and Y. The rib height Z is the length of a side of the trap space sections 3501 in the direction of gravity. The rib intervals X and Y are lengths of sides of each of the trap space sections 3501 in horizontal directions. In the present embodiment, the rib interval X is equal to the rib interval Y, and the opening of each of the trap space sections 3501 has a square shape. Among the rib intervals X and Y, only the rib interval X is used in the following description.

First, the rib thickness T is described. Foreign substances that entered the storage tank 3002 settle and are deposited on the upper surface of the ribs 3502 or in the trap space sections 3501. Rising of the foreign substances that have been deposited in the trap space sections 3501 can be prevented. However, the foreign substances that have been deposited on the upper surface of the ribs 3502 may reenter the application liquid during circulation. Therefore, in order to increase the efficiency in trapping foreign substances, it is necessary to reduce the area of the upper surface of the ribs 3502 and hence it is desirable to reduce the rib thickness T. In the present embodiment, the rib thickness T is 1 mm.

Instead of reducing the rib thickness T, the area of the upper surface of the ribs 3502 can be reduced by forming the ribs 3502 in a substantially tapering shape or by champhering the ridges in the upper portions of the ribs 3502.

Figure 7:
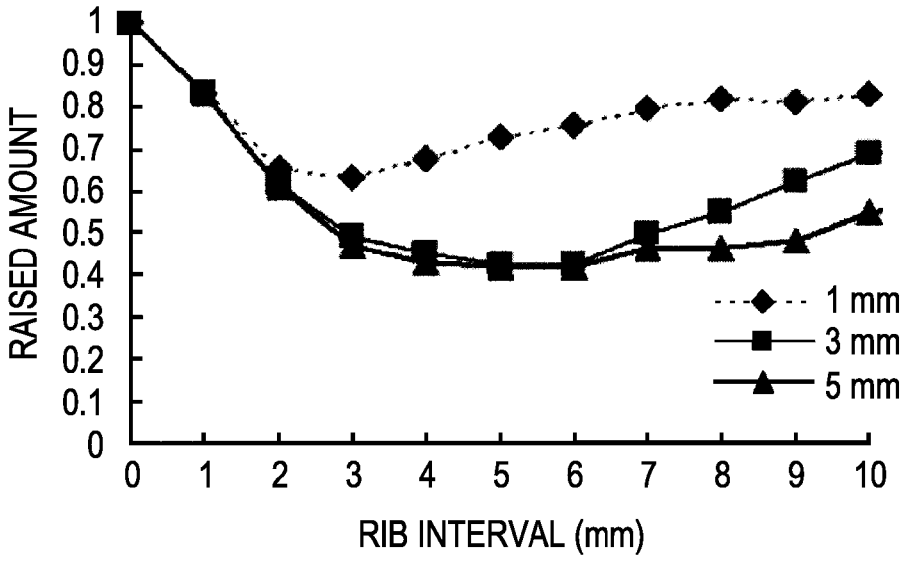
FIG. 7 is a graph illustrating a relationship between the rib interval of the storage tank and the raised amount of foreign substances.

Second, the rib height Z is described. FIG. 7 illustrates a relationship between the rib interval X and the raised amount of foreign substances for respective values of the rib height Z. The raised amount of 1 corresponds to a case without the trap space sections 3501. The smaller the raised amount, the higher the efficiency in trapping. In the present embodiment, the flow rate of the application liquid is assumed to be 1 cc/sec.

As can be seen from FIG. 7, the raised amount of foreign substances is smaller when the rib height Z is 3 mm or 5 mm than when the rib height Z is 1 mm. When the rib height Z is equal to or greater than 3 mm, foreign substances are sufficiently trapped. Thus, in the present embodiment, the rib height Z is determined to be equal to or greater than 3 mm. With consideration of a case when the amount of foreign substances increases, it is advantageous to increase the rib height Z, since the capacity of the trap space sections 3501 is increased and a large amount of foreign substances can be trapped.

Figure 8:
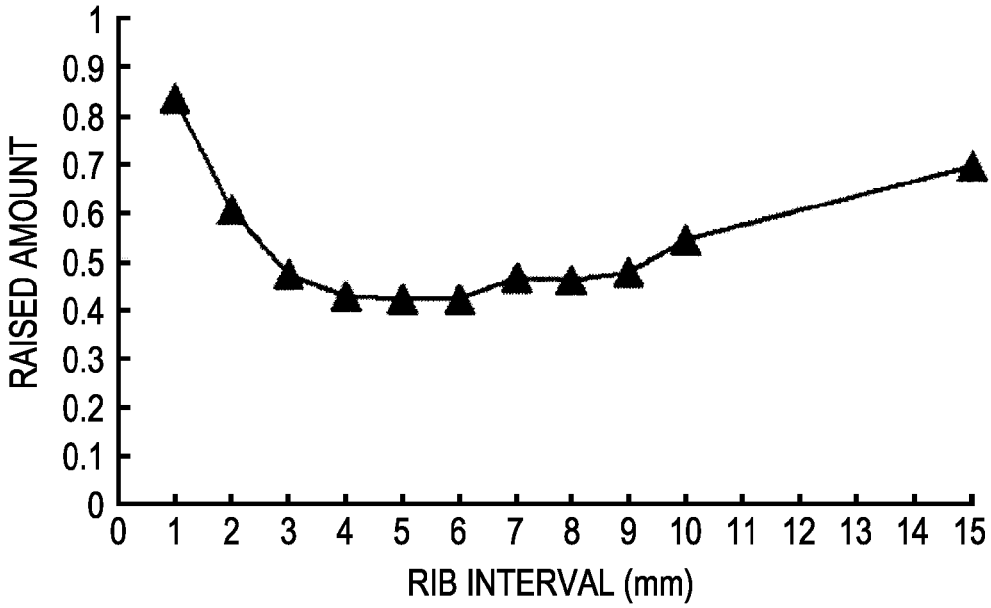
FIG. 8 is a graph illustrating a relationship between the rib interval of the storage tank and the raised amount of foreign substances.

Third, the rib interval X is described. FIG. 8 illustrates a relationship between the rib interval X and the raised amount. In this case, the rib thickness T is 1 mm, and the rib height Z is 5 mm. As can be seen from FIG. 8, the efficiency of trapping is high when the rib interval X is equal to or greater than 2 mm. The efficiency in trapping is particularly high when the rib interval X is in the range from about 2 mm to 10 mm.

Figure 9:
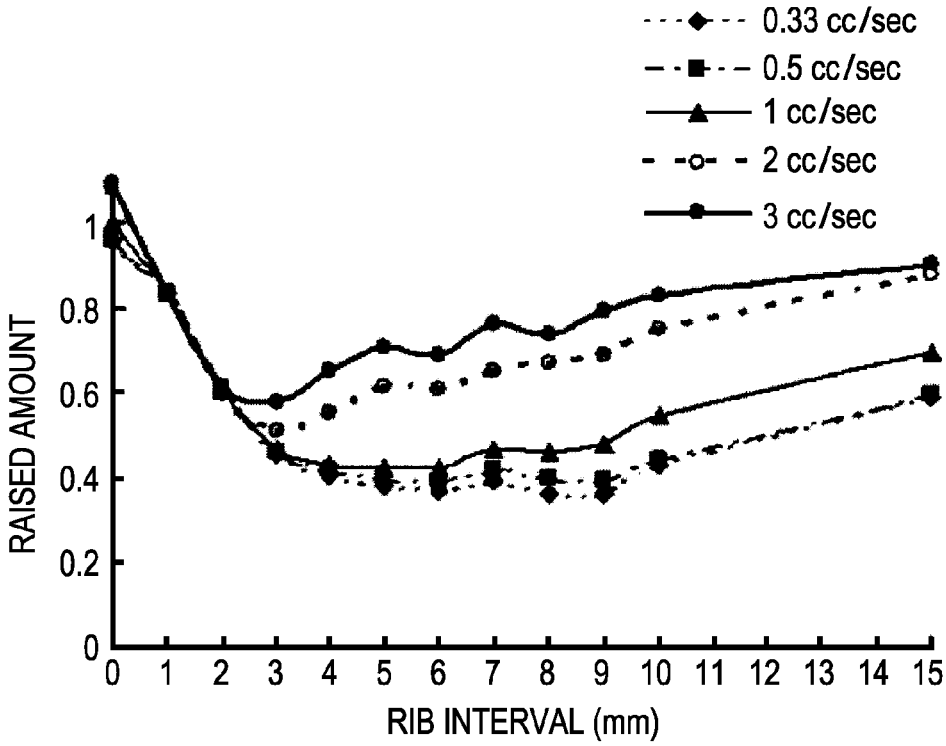
FIG. 9 is a graph illustrating a relationship between the rib interval of the storage tank and the raised amount of foreign substances.

FIG. 9 illustrates a relationship between the rib interval X and the raised amount when the flow rate of the application liquid is changed in the present embodiment. As can be seen from FIG. 9, although the efficiency in trapping the foreign substances generally decreases when the flow rate of the application liquid increases, the amount of increase is not substantial.

Thus, the rib interval X in the present embodiment is determined to be in the range from 2 mm to 10 mm.

In the present embodiment, the ribs 3502 are integrally formed with the storage tank 3002. Since additional materials for making the ribs 3502 are not necessary, the present embodiment is cost efficient and easily assembled. Moreover, advantages the same as those of the present embodiment can be obtained if, instead of integrally forming the ribs 3502 with the storage tank 3002, the ribs 3502 as independent members are disposed on the bottom surface of the storage tank 3002 so as to provide the trap space sections 3501. The ribs 3502 as independent members can be disposed in the bottom portion of the storage tank 3002, that is, in contact with or in the vicinity of the bottom surface of the storage tank 3002. It is sufficient that a structure that suppresses the effect of the flow of the application liquid in the storage tank be disposed in the bottom portion of the storage tank.

Figure 10:
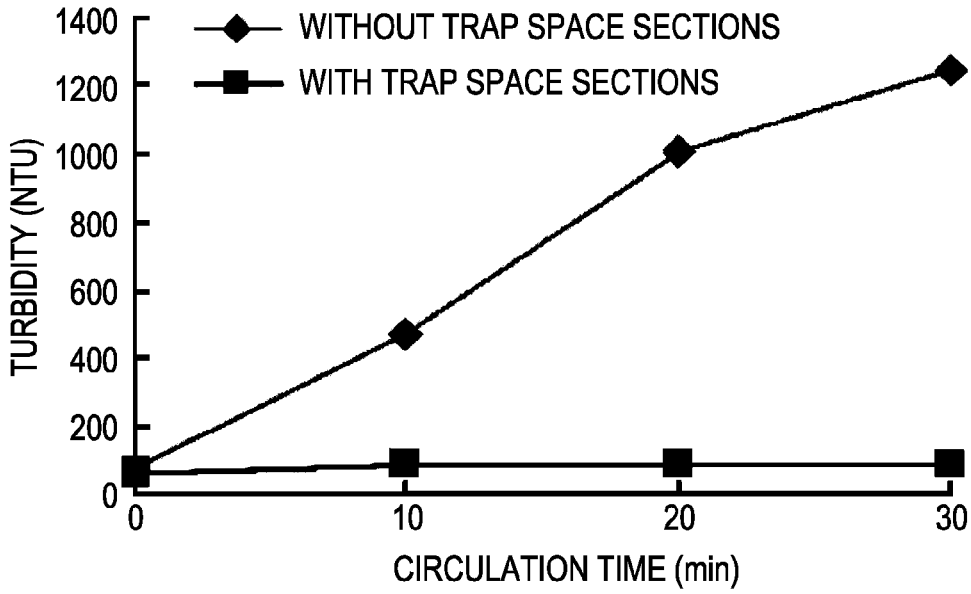
FIG. 10 is a graph illustrating an advantage obtained by providing the trap space sections.

The intersecting shape of the ribs 3502, that is, the shape of the opening of each of the trap space sections 3501 is not limited to the square shape in the case of the present embodiment. For example, the opening may have a rectangular shape, an octagonal shape, or a shape having curved lines. FIG. 10 illustrates a comparison of relationships between the circulation time and the turbidity in a case when the storage tank 3002 includes the trap space sections 3501 and in a case when the storage tank 3002 does not include the trap space sections. The turbidity of the application liquid was measured 10, 20, and 30 minutes after the application liquid began to be circulated at a flow rate of 1 cc/sec. The turbidity represents the degree to which the application liquid in the storage tank is turbid. The higher the turbidity, the larger the amount of foreign substances deposited in the tank being raised. The trap space sections 3501 have a rib thickness T of 1 mm, rib intervals X and Y of 5 mm, and a rib height Z of 5 mm. As can be seen from FIG. 16, in the case of "WITHOUT TRAP SPACE SECTIONS", the turbidity increases with increasing circulation time. In contrast, in the case of "WITH TRAP SPACE SECTIONS", the increase in the turbidity is suppressed when the circulation time increases. Thus, the advantage of the present invention can be clearly understood.

Control System

Figure 11:
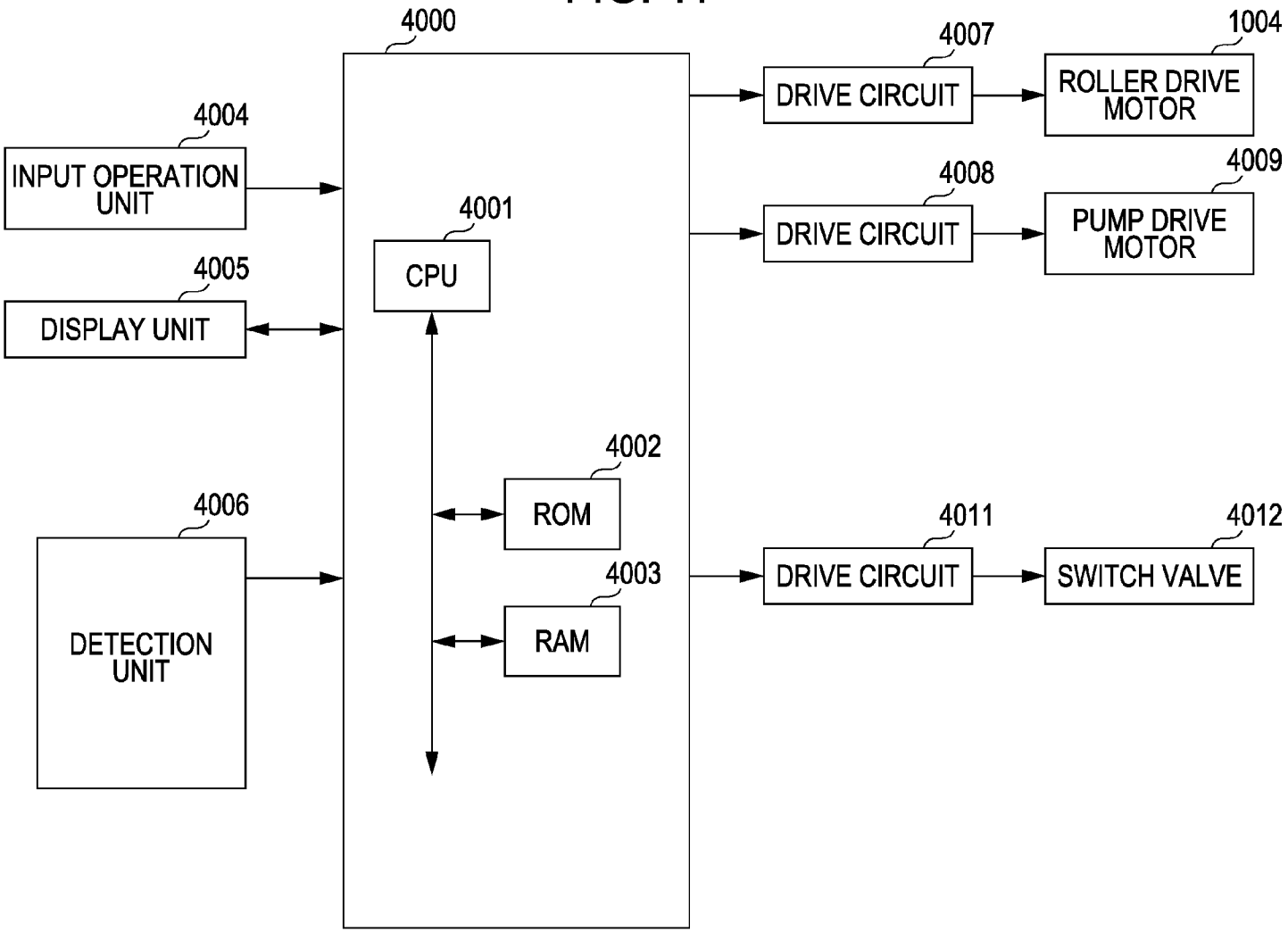
FIG. 11 is block diagram illustrating a control system of the liquid application mechanism.

FIG. 11 is a block diagram of a control system of the liquid application mechanism according to the present embodiment. Referring to FIG. 11, the control unit 4000 exercises an overall control of the liquid application mechanism. The control unit 4000 includes a CPU 4001 that performs processing such as various calculation, control, and determination. The control unit 4000 further includes a ROM 4002 and a RAM 4003. The ROM 4002 stores, for example, control programs executed by the CPU 4001. The RAM 4003 temporarily stores, for example, data being processed by the CPU 4001 and input data.

An input operation unit 4004 and a display unit 4005 are connected to the control unit 4000. The input operation unit 4004 includes switches and keyboards for inputting data and predetermined instructions. The display unit 4005 displays various information such as an input/set state of the liquid application mechanism. Moreover, a detection unit 4006 is connected to the control unit 4000. The detection unit 4006 includes sensors for detecting the position of an application medium and the operation state of members of the liquid application mechanism, and the like. The liquid detection sensor Y001 is included in the detection unit 4006. Furthermore, a roller drive motor 1004, a pump drive motor 4009, and first to fifth switch valves 4012 are connected to the control unit 4000 via drive circuits 4007, 4008, and 4011, respectively.

Liquid Application Sequence

Figure 12:
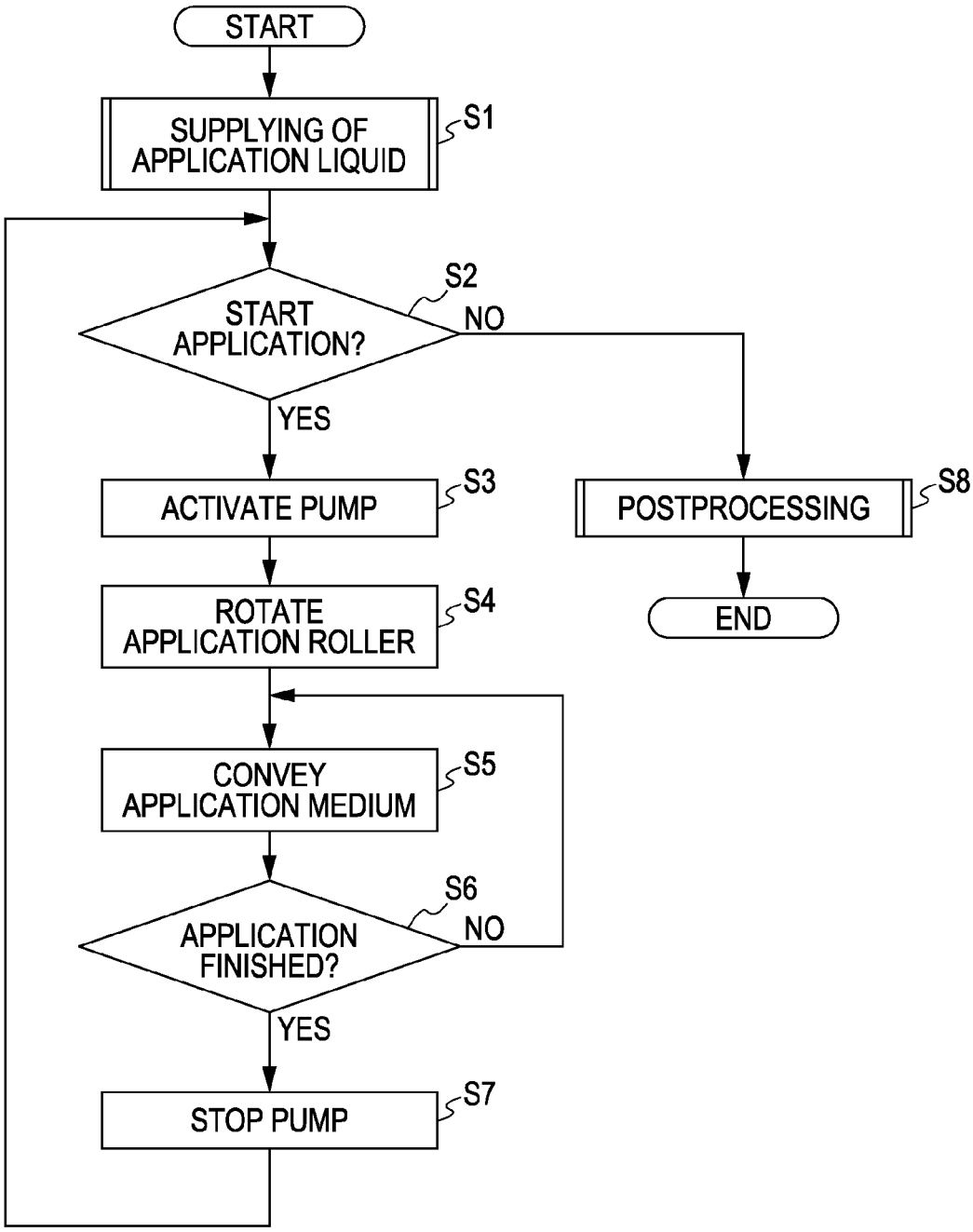
FIG. 12 is a flowchart illustrating a liquid application operation of the liquid application mechanism.

FIG. 12 is a flowchart representing the steps for applying the liquid with the liquid application mechanism according to the present embodiment. Hereinafter, the steps are described with reference to FIG. 12. When the liquid application mechanism is switched on, the control unit 4000 executes a liquid application sequence in accordance with the flowchart illustrated in FIG. 12.

In the liquid application mechanism according to the present embodiment, there are four combinations of "Open" and "Close" of the shut-off valves referred to as "Default", "Supply", "Circulate", and "Recover" shown in Table 1. The control unit 4000 selects an appropriate combination among the four combinations and sends control signals to the shut-off valve so as to make the shut-off valves perform operations corresponding to the control signals.

TABLE 1

| | First shut-off valve | Second shut-off valve | Third shut-off valve | Fourth shut-off valve | Fifth shut-off valve |
|---|---|---|---|---|---|
| Default | Close | Open | Close | Close | Close |
| Supply | Close | Close | Close | Open | Open |
| Circulate | Open | Close | Open | Close | Close |
| Recover | Close | Open | Open | Close | Close |

The combination named "Default" corresponds to a state of the shut-off valves when the pump 3007 is not in operation after the application liquid in the liquid holding space S has been recovered to the storage tank 3002. The combination named "Supply" corresponds to a state of the shut-off valve when the application liquid is supplied from the replaceable tank 3001 to the storage tank 3002. The combination named "Circulate" corresponds to a state of the shut-off valves when the application liquid is circulated around the storage tank 3002, the first channel, the liquid holding space S, and the second channel. The combination named "Recover" corresponds to a state of the shut-off valves when the application liquid is recovered from the liquid holding space S to the storage tank 3002.

In the "Default" combination, the second shut-off valve may be "Open" instead of "Close". In this case, the liquid holding space S and the storage tank 3002 are completely shut off from each other, so that the application liquid in the storage tank 3002 is prevented from entering the liquid holding space S while the liquid application mechanism is not in operation.

(1) Filling Step

Figure 13:
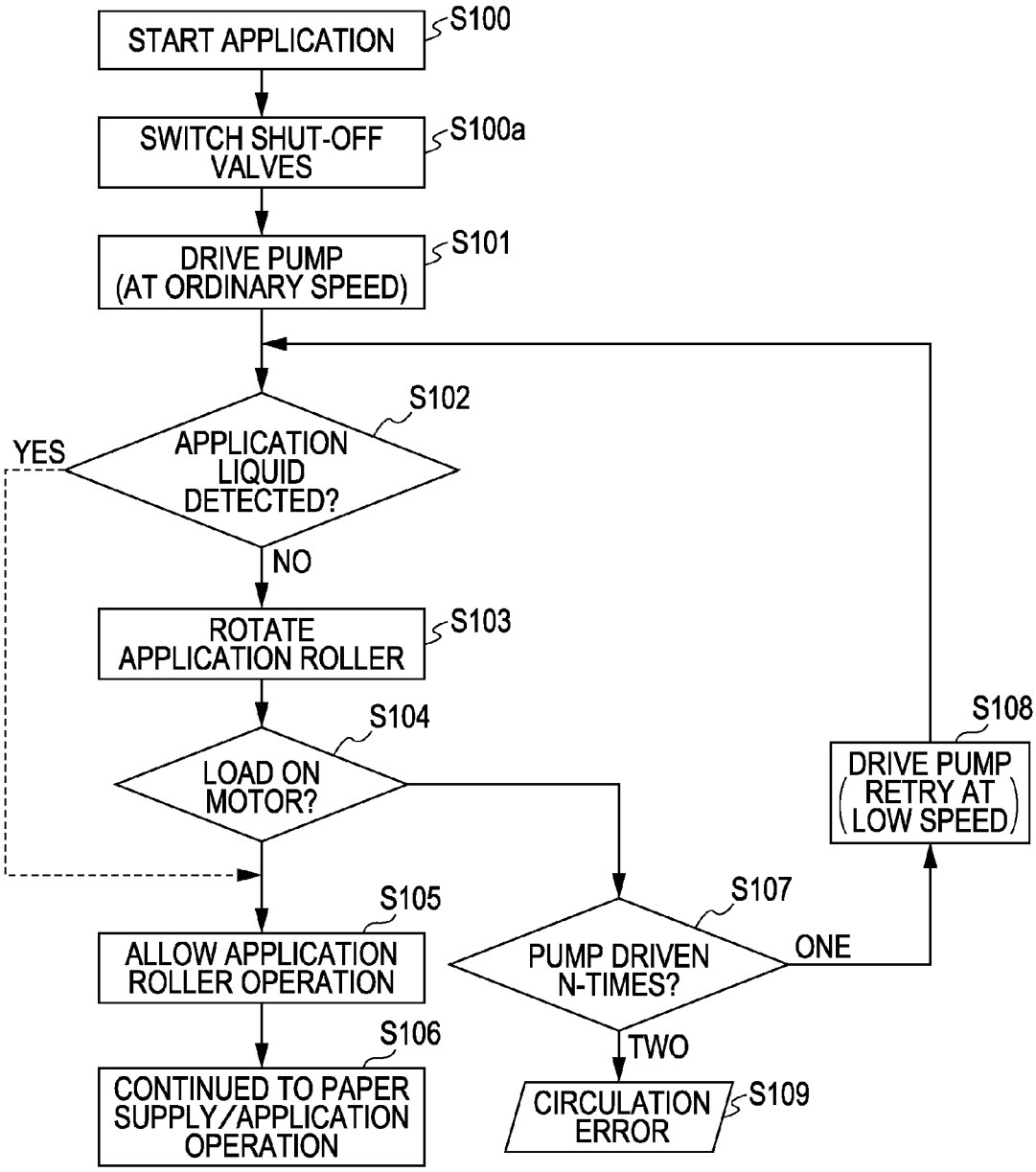
FIG. 13 is a flowchart illustrating a filling operation performed by the liquid application mechanism.

Referring to FIG. 12, step S1 is a step of filling the application space S with the application liquid. FIG. 13 is a flowchart of detailed operations of the filling step. At the start of the filling step, the state of the shut-off valves are set to "Circulate" open/close combination (step S100*a*). With this open/close combination, the liquid application space S communicates with the storage tank 3002 through the first channel and the second channel.

Subsequently, while monitoring the presence of the application liquid with the liquid detection sensor Y001, the pump 3007 is driven (step S101). With this operation, the application liquid flows through the first channel, the liquid application space S, and the tube 3103, to the liquid detection sensor Y001. When the channel in the liquid detection sensor Y001 is filled with the application liquid, the liquid detection sensor Y001 detects the presence of liquid (step S102), and the pump 3007 is stopped. With this filling step, the application liquid is supplied to the application roller 1001, so that the application liquid is ready to be applied to the application medium (step S105).

(2) Supply Step

Referring to FIG. 12, in step S1, a monitoring device, such as a sensor, detects the height of the surface of the liquid in the liquid holding member. If it is determined that the storage tank 3002 is not sufficiently filled with the application liquid, the state of the shut-off valves is set to "Supply" open/close combination. Subsequently, the pump 3007 is driven for a certain period. With this open/close combination, the replaceable tank 3001 communicates with the storage tank 3002 through the third channel and the fourth channel. Thus, the application liquid is supplied to the storage tank 3002.

The supply operation is described. FIG. 3 illustrates the inside of the storage tank. For convenience of description, in the present embodiment, the inner space of the storage tank 3002 is assumed to be rectangular-parallelepiped-shaped. The tube 3101 communicates with the outlet 3402. The tube 3105 communicates with the inlet 3404. The tube 3109 communicates with an opening 3405. The tube 3107 of the fourth channel communicates with an opening 3403.

FIG. 3 illustrates a positional relationship among the outlet 3402, the inlet 3404, the opening 3405, the opening 3403, and a lower end 3401 of the air communication port 3004 in the vertical direction.

The outlet 3402 is disposed near the bottom of the storage tank 3002 in order to secure the effective capacity of the storage tank 3002 and suppress entry of bubbles into the first channel. However, the disposition of the outlet 3402 is not limited thereto, as long as the storage tank 3002 serves as a temporary storage of the application liquid supplied from the replaceable tank 3001, as in the present embodiment. As illustrated in FIG. 3, in the present embodiment, the outlet 3402 is disposed near the center of the storage tank 3002. Thus, even if the apparatus is inclined, the height of the surface of liquid at the outlet 3402 can be secured, whereby entry of bubbles into the first channel can be prevented.

It is necessary that the opening 3405 communicate with the air communication port 3004 through the inside of the storage tank 3002 so that the opening 3405 can communicate with air when the recovery operation is performed. Therefore, the opening 3405 is disposed near the upper surface of the storage tank 3002. The lower end 3401 of the air communication port 3004 is disposed as near as possible to the center of the storage tank 3002 in the height direction. The opening 3403 is disposed lower than the lower end 3401 of the air communication port 3004.

The application liquid is supplied to the storage tank 3002 until the liquid level rises to the opening 3403 at an end of the fourth channel in the storage tank 3002 (the state illustrated in FIG. 3). When the application liquid reaches the lower end of the opening 3403, which is an end of the fourth channel, the application liquid circulates between the replaceable tank 3001 and the storage tank 3002, so that the liquid level of the application liquid in the storage tank 3002 does not change. By disposing the lower end of the opening 3403, which is an end of the fourth channel, lower than the lower end 3401 of the air communication port 3004, the application liquid can be prevented from flowing out from the air communication port 3004.

With this structure, leakage of the application liquid from the storage tank 3002 can be prevented regardless of the period during which the pump 3007 is driven in the supply step.

Alternatively, a sensor may be provided in the storage tank 3002 so as to detect the liquid level of the application liquid. The sensor serves to control the liquid level of the application liquid so that the liquid level may not become lower than the lower end 3401 of the air communication port 3004. In this case, the fourth channel is not necessary. Considering the possibility that the sensor for detecting the liquid level may malfunction, both the sensor and the fourth channel may be provided.

As a further alternative, another sensor for detecting the liquid level may be disposed at a position nearer to the bottom surface of the storage tank 3002 than the sensor described above. In this case, when the other sensor detects that the amount of the application liquid in the storage tank 3002 has decreased, the control of starting the supply step can be triggered.

(3) Application Step

As illustrated in FIG. 12, when an application start instruction is input (step S2), the pump 3007 is reactivated (step S3), and the application roller 1001 starts rotating clockwise in the direction indicated by the arrow in FIG. 2 (step S4). Due to the rotation of the application roller 1001, the application liquid L in the liquid holding space S passes through a space between the application roller 1001 and a lower edge portion 2011 of the contact member 2009 against the pressure applied from the contact member 2009 of the liquid holding member 2001 to the application roller 1001. The application liquid L adheres to the outer peripheral surface of the application roller 1001 in the form of a layer. The application liquid L that has adhered to the application roller 1001 is supplied to a contact portion between the application roller 1001 and the counter roller 1002.

Figure 14:
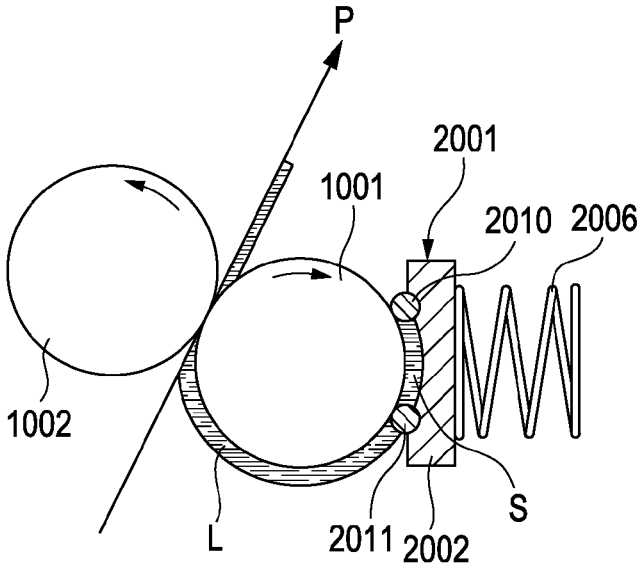
FIG. 14 is a schematic view illustrating the vicinity of the application roller of the liquid application mechanism.

Next, the application medium P, which has been conveyed by an application medium conveying mechanism 1006, is inserted between the application roller 1001 and the counter roller 1002. The application medium P is conveyed toward a paper ejecting section as the application roller 1001 and the counter roller 1002 rotate (step S5). As illustrated in FIG. 14, while the application medium P is being conveyed, the application liquid L that has adhered to the application roller 1001 is transferred from the application roller 1001 to the application medium P. A mechanism for supplying the application medium P to a space between the application roller 1001 and the counter roller 1002 is not limited to the conveying mechanism described above.

In FIG. 14, a region with horizontal hatching represents the application liquid L. The thickness of the layer of the application liquid L on the application roller 1001 and the application medium P is exaggerated in FIG. 14 so as to clearly illustrate the application operation of the application liquid L.

A portion of the application medium to which the application liquid has been applied is conveyed in the direction indicated by the arrow with traction of the application roller 1001. At the same time, a portion of the application medium P to which the application liquid L has not been applied is conveyed to the contact portion between the application medium P and the application roller 1001. By performing this operation continuously or intermittently, the application liquid is applied to the entire area of the surface of the application medium.

FIG. 14 illustrates an ideal state in which all of the application liquid L that has passed through a space between the lower edge portion 2011 of the contact member 2009 and the application roller 1001 and has adhered to the application roller 1001 is transferred to the application medium P. In practice, however, all of the application liquid L that has adhered to the application roller 1001 may not be necessarily transferred to the application medium P. That is, when the application medium P is conveyed and separated from the application roller 1001, a portion of the application liquid L tends to remain on the outer peripheral surface of the application roller 1001. The amount of the application liquid L remaining on the application roller 1001 varies depends on the material of the application medium P or the asperity of the application medium P. However, in almost any cases when the application medium P is plain paper, the application liquid L remains on the outer peripheral surface of the application roller 1001 after the application operation.

The application liquid L remaining on the application roller 1001 passes through a space between the application roller 1001 and an upper edge portion 2010 of the contact member 2009 against the pressure from the contact member 2009 of the liquid holding member 2001 to the application roller 1001, and reenters the liquid holding space S. The application liquid that has reentered the liquid holding space S is mixed into the application liquid that has been supplied to the space S.

The application liquid reenters the liquid holding space S when the application medium is not present and the application roller 1001 is rotated. That is, when the application roller 1001 rotates, the application liquid that has adhered to the outer peripheral surface of the application roller 1001 passes through a space (nip) between the application roller 1001 and the counter roller 1002. The application liquid that has passed through the nip is separated from the counter roller 1002 and remains on the outer peripheral surface of the application roller 1001. The application liquid L that adheres to the application roller 1001 passes through a space between the upper edge portion 2010 of the contact member 2009 and the application roller 1001, enters the liquid holding space S, and is mixed into the application liquid in the liquid holding space S.

(4) Finishing Process

As illustrated in FIG. 12, after the application operation on the application medium has been performed, it is determined whether the application process may be finished (step S6). If the application process is not finished, the process returns to step S5, and the application operation is repeated until the application liquid has been applied to all the necessary areas of the application medium. When the application process is finished, the pump 3007 is stopped (step S7). Subsequently, the process proceeds to step S2. If the application start instruction has been input, the operations in steps S2 to S7 described above are repeated. If the application start instruction has not been input, postprocessing including the recovery operation for recovering the application liquid from the application space S and the liquid channel 3000 is performed (step S8), which concludes processing related to application.

In the recovery operation, the open/close combination of the shut-off valves is set to "Recover" open/close combination, and the pump 3007 is driven for a certain period. With this open/close combination, the liquid application space S communicates with the storage tank 3002 through the second channel, and the liquid application space S communicates with the air communication port 3004 through the first channel. Thus, air is supplied to the tube 3102, the liquid application space S, the tube 3103, the tube 3104, the pump 3007, and the tube 3105, and the application liquid is recovered to the storage tank 3002. With this recovery operation, evaporation of the application liquid from the liquid holding space S is prevented or reduced.

After the recovery operation has finished, the open/close combination of the shut-off valves is set to "Default" open/close combination. With this open/close combination, the replaceable tank 3001, the storage tank 3002, and the liquid application space S are shut off from one another. Thus, even if the apparatus is inclined while the apparatus is being moved or transported, flow of the application liquid among the tanks and leakage of the application liquid to the outside can be prevented or reduced.

In the present embodiment, the supply of the application liquid from the replaceable tank 3001 to the storage tank 3002 and the circulation of the application liquid to the liquid holding space S are independently performed. However, these operations may be performed simultaneously. In this case, the first shut-off valve 3201 is closed, and the second to fifth shut-off valves 3202 to 3205 are opened.

Embodiment of Inkjet Recording Apparatus

Figure 15:
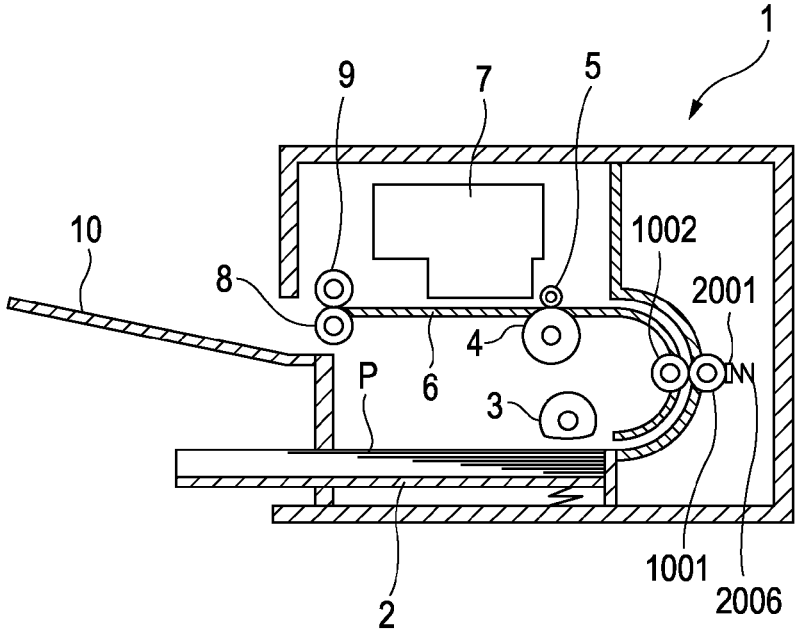
FIG. 15 is a schematic view of an inkjet recording apparatus including the liquid application mechanism.

FIG. 15 is a schematic view of an inkjet recording apparatus including the liquid application mechanism illustrated in FIGS. 1 to 3.

The inkjet recording apparatus 1 includes a paper supply tray 2 on which a plurality of recording media P can be stacked. A separation roller 3, which has a semicircular shape, separates the recording media P stacked on the paper supply tray 2 one by one and feeds the recording medium P to a conveying path. On the conveying path, the application roller 1001 and the counter roller 1002 of the liquid application unit of the liquid application mechanism are disposed. (For convenience of drawing, other members of the liquid application mechanism are omitted.) The recording medium P that has been fed from the paper supply tray 2 is conveyed to a space between the rollers 1001 and 1002. The application roller 1001, being rotated by the roller drive motor, rotates clockwise in FIG. 15. While conveying the recording medium P, the application roller 1001 applies the application liquid to the recording surface of the recording medium P. After the application liquid has been applied to the recording medium P, the application medium P is conveyed to a space between a conveying roller 4 and the pinch roller 5. While the conveying roller 4 rotates counterclockwise in FIG. 15, the recording medium P is conveyed on a platen 6 to a position facing a recording head 7 serving as a recording unit. The recording head 7 is an inkjet recording head in which a predetermined number of ink ejection nozzles are arranged. While scanning the recording medium P in the vertical direction, the recording head 7 performs recording by ejecting ink droplets onto the recording surface of the recording medium P in accordance with data to be recorded. The recording operation and a conveying operation, with which the recording medium is conveyed by the conveying roller 4 by a predetermined amount, are performed in an alternating manner, so that an image is formed on the recording medium. While the image is being formed, an eject roller 8 and a spur roller 9, which are disposed downstream of a scanning region of the recording head on the conveying path of the recording medium, nip the recording medium P. With the rotation of the eject roller 8, the recording medium P is discharged onto a paper output tray 10.

The inkjet recording apparatus may be a so-called full-line inkjet recording apparatus that performs recording using a long recording head in which ejection nozzles are arranged over the entire length of the recording medium.

The application liquid used in the present embodiment is a process liquid that accelerates aggregation of ink including pigment as a coloring material. The process liquid reacts with the ink ejected onto the recording medium on which the process liquid has been applied. Thus, the pigment serving as the coloring material of the ink is insolubilized in the process and the aggregation of the pigment is accelerated. Since the pigment is insolubilized, the recording density can be improved and occurrence of an ink blot can be prevented. Moreover, bleeding can be reduced or prevented. The application liquid used in the inkjet recording apparatus is not limited to the application liquid described above.

FIG. 28 is a flowchart illustrating an liquid application process and the corresponding recording operation of the inkjet recording apparatus of the present embodiment.

Steps S11, S13, S14, S15, and S19 correspond to steps S1, S3, S4, S5, and S7 of the flowchart of FIG. 12, respectively.

Figure 16:
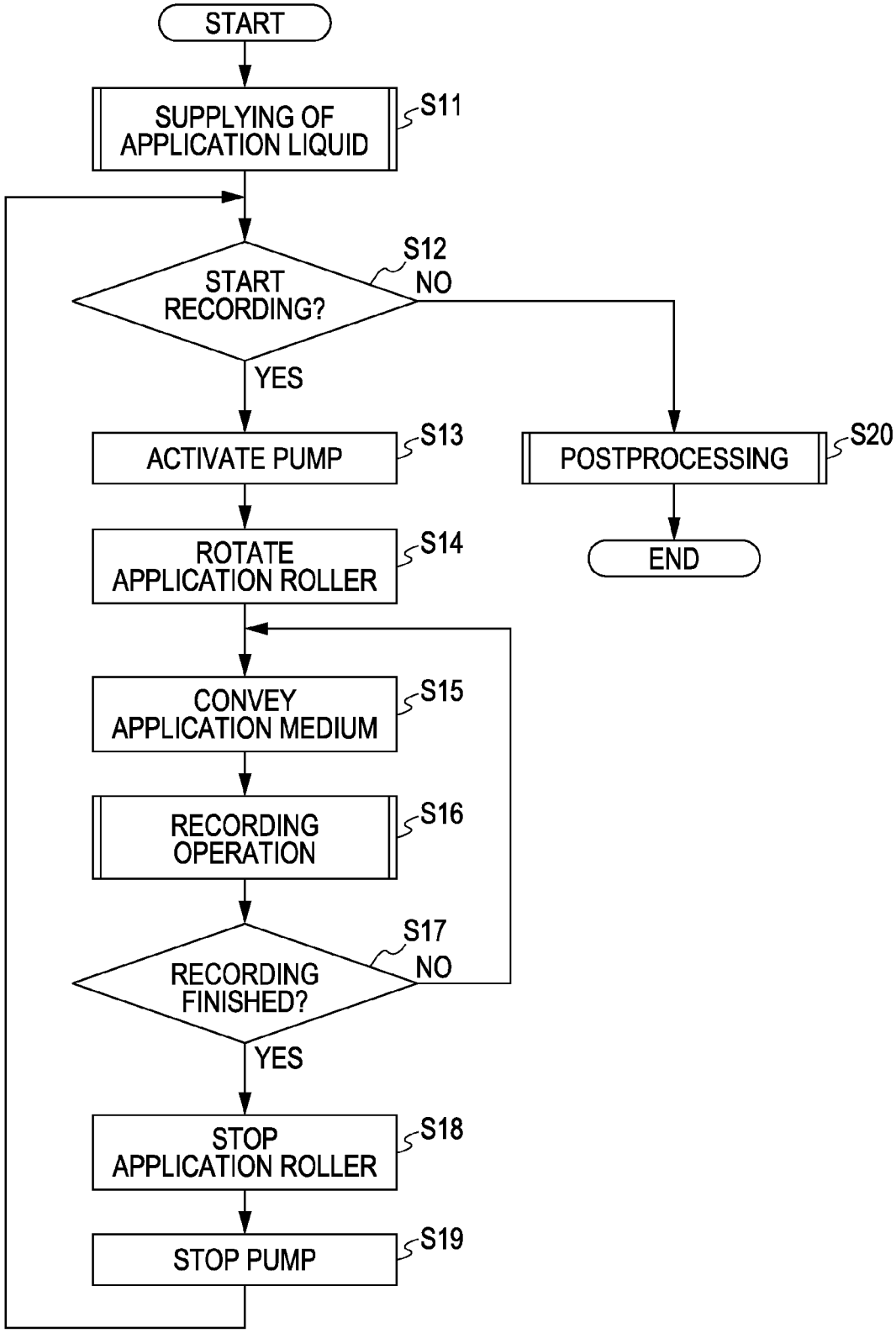
FIG. 16 is a flowchart illustrating a recording operation performed by the inkjet recording apparatus.

As illustrated in FIG. 16, in the present embodiment, when a recording start instruction is issued (step S12), a series of liquid application operations, such as driving of a pump, are performed (step S13-S15). Application liquid is applied to an appropriate region of a recording medium serving as the application medium of the liquid application mechanism.

Subsequent to the application process, a recording operation is performed on the region of the recording medium to which the application liquid has been applied (step S16). That is, while the recording head 7 scans the recording medium P that is being conveyed by a predetermined amount at a time by the conveying roller 4, ink is ejected from the nozzles in accordance with the data to be recorded, so that the ink adheres to the recording medium and forms dots on the recording medium. The ink adhering to the recording medium reacts with the application liquid, so that the recording density can be improved and occurrence of an ink blot can be prevented. By repeating the conveying operation of the recording medium and the scanning operation by the recording head, recording is performed on the recording medium P. When recording has finished, the recording medium is discharged onto the paper output tray 10. If it is determined in step S17 that recording has finished, the steps S18 to S20 are performed, which concludes the process.

The inkjet recording apparatus of the present embodiment applies the liquid on the recording medium and successively performs recording on the portions of the recording medium on which the liquid has been applied. That is, the length of the conveying path from the application roller to the recording head is smaller than the length of the recording medium. When a portion of the recording medium on which the application liquid has been applied reaches the scanning region of the recording head, liquid application mechanism applies the application liquid on another portion of the recording medium located upstream of the scanning region on the conveying path. In this case, every time the recording medium is conveyed by a predetermined amount, application of the liquid and recording are successively performed on different portions of the recording medium. However, as a modification of the present embodiment, recording may be performed after application of the liquid on a recording medium has finished.

As described above, the application liquid used in the present embodiment accelerates aggregation of pigment, which serves as a coloring material of ink, while recording is performed using the ink.

Examples of materials of the application liquid are described below.

| | |
|---|---|
| Calcium Nitrate Tetrahydrate | 10% |
| Glycerin | 42% |
| Surfactant | 1% |
| Water | residual quantity |

The viscosity of the application liquid is 5 to 6 cP (centipoise) at 25° C.

The materials of the application liquid used in the present invention are not limited to the above-described materials. For example, a different liquid including a material that insolubilizes or aggregates the pigment can be used. Alternatively, a different liquid including a material that suppresses curling of the application medium (a phenomenon that the application medium becomes warped) can be used.

When the application liquid includes water, friction generated at the contact portions of the application roller and the liquid holding member of the present invention can be reduced by adding a material that reduces the surface tension of water to the application liquid. In the above-described example of materials, glycerin and the surfactant are materials that reduces the surface tension of water.

The application liquid applied by the liquid application mechanism of the inkjet recording apparatus of the present embodiment may include, for example, a fluorescent brightening agent. By applying the liquid to the recording medium, the whiteness of the recording medium can be increased. In this case, even if recording is performed by, instead of the inkjet recording method, a thermal transfer method or an electrophotographic method after the liquid has been applied, advantages similar to those describe above can be obtained. The liquid application mechanism can be applied to a recording apparatus using silver halide photography. In this case, the liquid application mechanism may be used for applying sensitizer before recording is performed.

When the liquid application mechanism is applied to inkjet recording apparatus of the present embodiment, the foreign substances to be removed from the application liquid are mainly paper powder most of which settles in the application liquid.

Examples of materials and the size of a particle of each of the materials included in the paper powder are shown below. Paper powder includes pulp and fillers (such as calcium carbonate, kaoline, and talc).

| | |
|---|---|
| Pulp | 10 to 50 μm |
| Calcium Carbonate | smaller than 10 μm |
| Kaoline | about 10 μm |
| Talc | about 40 to 50 μm |

However, in the present embodiment, foreign substances that can be removed from the application liquid are not limited thereto.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-320810 filed Dec. 17, 2008, No. 2009-110996 filed Apr. 30, 2009, and No. 2009-236436 filed Oct. 13, 2009, which are hereby incorporated by reference herein in their entirety.

What is claimed is:

1. A liquid application mechanism comprising:

a liquid application unit that applies liquid to an application medium, the liquid being supplied; and a liquid supply unit that supplies liquid stored in a storage unit to the liquid application unit by making the liquid flow out from an outlet of the storage unit, and recovers a portion of the liquid to the storage unit by making the portion of the liquid flow into the storage unit through an inlet of the storage unit, the portion of the liquid being the liquid that has been supplied to the liquid application unit and has not been applied to the application medium by the liquid application unit, wherein, a plurality of trap space sections are formed at a bottom portion of the storage unit, the trap space sections being separated from each other with wall members, the trap space sections having continuous rectangular shapes, sides of each of the trap space sections being surrounded by the wall members, the trap space sections being open upward in a direction opposite to gravity, the trap space sections having a length equal to or greater than 3 mm in a direction of gravity and a length in the range from 2 mm to 10 mm in a horizontal direction.

2. The liquid application mechanism according to claim 1, wherein the outlet and the inlet are disposed above an upper surface of the wall members in the direction opposite to gravity.

3. The liquid application mechanism according to claim 1, wherein the wall members are integrally formed with a bottom surface of the storage unit.

4. An inkjet recording apparatus comprising:

the liquid application mechanism according to claims 1, wherein, after the liquid application mechanism has applied the liquid to the application medium, recording is performed on the application medium by ejecting ink onto a portion of the application medium to which the liquid has been applied.

* * * * *